US008971768B2

(12) United States Patent
Senda et al.

(10) Patent No.: US 8,971,768 B2
(45) Date of Patent: Mar. 3, 2015

(54) DEVELOPER CONTAINER INCLUDING AN ELASTICALLY DEFORMABLE TRANSPORTING MEMBER AND IMAGE FORMING APPARATUS INCLUDING THE DEVELOPER CONTAINER

(75) Inventors: Seiichi Senda, Anjo (JP); Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 109 days.

(21) Appl. No.: 13/542,802

(22) Filed: Jul. 6, 2012

(65) Prior Publication Data

US 2013/0011163 A1 Jan. 10, 2013

(30) Foreign Application Priority Data

Jul. 8, 2011 (JP) ..... 2011-151771
Jun. 19, 2012 (JP) ..... 2012-137523

(51) Int. Cl.
*G03G 15/08* (2006.01)

(52) U.S. Cl.
CPC ..... *G03G 15/0865* (2013.01); *G03G 15/0877* (2013.01)
USPC ..... 399/254

(58) Field of Classification Search
USPC ..... 399/254, 27
See application file for complete search history.

(56) References Cited

U.S. PATENT DOCUMENTS 6,421,517 B1 * 7/2002 Nishino et al. ..... 399/254
7,860,437 B2 12/2010 Kakuta et al.
7,899,367 B2 3/2011 Fukuta
8,036,543 B2 * 10/2011 Yokomori et al. ..... 399/27
2006/0238599 A1 10/2006 Kishi et al.
2007/0196135 A1 8/2007 Fukuta
2008/0247784 A1 10/2008 Kakuta et al.
2011/0076062 A1 3/2011 Kakuta et al.

FOREIGN PATENT DOCUMENTS

CN 1854935 A 11/2006
JP 10-239973 9/1998

(Continued)

OTHER PUBLICATIONS

Office Action issued in corresponding Chinese Patent Application No. 201210230264.7 mailed Jan. 24, 2014. (English language translation of the Office Action obtained from Industrial Property Digital Library of the JPO).

(Continued)

*Primary Examiner* — Quana M Grainger
(74) *Attorney, Agent, or Firm* — Banner & Witcoff, Ltd.

(57) ABSTRACT

A developer container includes a developer accommodating chamber and a transporting member configured to elastically deform, to rotate, and to transport the developer accommodated in the developer accommodating chamber. The developer accommodating chamber includes a dividing wall configured to deform the transporting member by making a sliding contact with the transporting member. The developer accommodating chamber further includes a communicating portion configured to allow the transporting member, which has been elastically deformed by the sliding portion, to restore. The developer accommodating chamber still further includes a contacting portion. The transporting member restored by the communicating portion being configured to contact with the contacting portion.

32 Claims, 5 Drawing Sheets

(56) References Cited

FOREIGN PATENT DOCUMENTS

| | | |
|---|---|---|
| JP | 2007-219410 A | 8/2007 |
| JP | 2008-170951 | 7/2008 |

OTHER PUBLICATIONS

Oct. 16, 2014—(CN) Second Office Action—App 201210230264.7—Eng Tran.

* cited by examiner

DEVELOPER CONTAINER INCLUDING AN ELASTICALLY DEFORMABLE TRANSPORTING MEMBER AND IMAGE FORMING APPARATUS INCLUDING THE DEVELOPER CONTAINER

CROSS REFERENCE TO RELATED APPLICATION

The present application claims priority from Japanese Patent Application Nos. 2011-151771 and 2012-137523, filed on Jul. 8, 2011, and Jun. 19, 2012, respectively, the disclosures of which are incorporated herein by reference in their entirety.

BACKGROUND OF THE INVENTION

1. Field of the Invention

The present invention relates to an image forming apparatus in which an electrophotography is adopted, and a developer container which is equipped in the image forming apparatus.

2. Description of the Related Art

As an electrophotographic color printer, an intermediate-transfer type color printer which includes a plurality of developing units, a plurality of photosensitive drums which are disposed in parallel above the developing units corresponding to the respective developing units, an endless belt which makes a contact with each photosensitive drum from an upper side thereof, and a secondary transfer roller which makes a contact with one end of the endless belt has hitherto been known.

As a developing unit which is equipped in such intermediate-transfer type color printer, for instance, a developing unit which includes a developing chamber in which a supply roller, a developing roller and a stirring member are provided, and a developer accommodating chamber disposed below the developing chamber, which accommodates a developer such as toner, and in which a transporting member configured to transport the developer to the developing chamber is provided, has been proposed.

Moreover, in such developing unit, the developer accommodated in the developer accommodating chamber is charged in the developing chamber from a direction of rotation of the transporting member, by the transporting member which is rotatably provided, and is supplied to the supply roller while being stirred by the stirring member in the developing chamber.

SUMMARY OF THE INVENTION

However, in the developing unit in which the developing chamber is disposed above the developer accommodating chamber, the developer is supplied from the developer accommodating chamber to the developing chamber against the gravitational force. Therefore, there is a fear that the developer is not supplied evenly to the developing chamber, which may give rise to an uneven level of developer. Moreover, due to such uneven level of developer, the developer may not be supplied uniformly to the supply roller, and furthermore, the developer may not be carried uniformly on the developing roller, which may lead to a defective image formation.

Therefore, in the above described developing unit, the uneven level of the developer is suppressed by providing the stirring member and stirring the developer.

However, when the stirring member is provided in the developing chamber, the structure of the developing unit becomes complicated, and facilitating small-sizing and cost-reduction of the developing unit becomes difficult.

Therefore, an object of the present invention is to provide a developer container which is capable of preventing the defective image formation caused due to the uneven level of developer while having a simple structure, and an image forming apparatus equipped with the developer container.

According to a first aspect of the present invention, there is provided a developer container including:

a developer accommodating chamber configured to accommodate the developer; and a transporting member configured to elastically deform and to rotate in the developer accommodating chamber, and further configured to transport the developer accommodated in the developer accommodating chamber, wherein the developer accommodating chamber includes:

a dividing wall having a sliding portion configured to deform the transporting member by making a sliding contact with the transporting member, the dividing wall defining a part of the developer accommodating chamber to divide the developer accommodating chamber and an upper space thereof;

a communicating portion arranged at a downstream side in a direction of rotation of the transporting member with respect to the sliding portion, the communicating portion communicating an inner side and an outer side of the developer accommodating chamber, the communicating portion being configured to allow the transporting member, which has been elastically deformed by the sliding portion, to restore; and a contacting portion arranged at the downstream side in the direction of rotation of the transporting member with respect to the communicating portion, the transporting member restored by the communicating portion being configured to contact with the contacting portion.

When such an arrangement is made, the transporting member makes a sliding contact with the sliding portion by rotating, and is elastically deformed along the shape of the sliding portion. Moreover, when the transporting member rotates further and moves from the sliding portion to the communicating portion, the sliding contact between the sliding portion and the transporting member terminates, and the transporting member which has been deformed is restored toward the downstream side of the direction of rotation, or in other words, toward the contacting portion. Therefore, a part of the developer transported by the transporting member is dispersed by being discharged to the communicating portion with the restoration of the transporting member. Moreover, the developer which has not been discharged to the communicating portion is transported toward the contacting portion, and collides with the contacting portion together with transporting member.

As the developer hits the contacting portion, the developer which has been transported to the contacting portion upon being discharged is supplied from the contacting portion to an outside of the developer accommodating chamber with an air flow generated by the collision of the transporting member with the contacting portion. Moreover, by the air flow, the developer discharged to the communicating portion is also supplied to the outside of the developer accommodating chamber. In other words, the developer dispersed is supplied to the outside of the developer accommodating chamber from a direction opposite to the direction of rotation of the transporting member. Therefore, it is possible to suppress the uneven level of developer supplied to the outside of the developer accommodating chamber as compared to a case in which, the developer is charged by the transporting member from the direction of rotation of the transporting member to the outside of the developer accommodating chamber.

Consequently, it is possible to suppress the uneven level of developer supplied to the developer accommodating chamber, and to prevent defective image formation due to the uneven level of developer, while facilitating small-sizing and cost-reduction.

According to a second aspect of the present invention, there is provided an image forming apparatus configured to form an image on a medium, including:

a plurality of developer containers according to the first aspect of the present invention;

a plurality of photosensitive drums arranged above the developer containers, corresponding to the plurality of developer containers;

an endless belt arranged above the photosensitive drums;

a plurality of primary transfer rollers arranged to face the photosensitive drums, sandwiching the endless belt between the primary transfer rollers and the photosensitive drums; and a secondary transfer roller arranged at one end side of the endless belt.

According to such an arrangement, since the developer is supplied to the supply roller uniformly, and is held on the developing roller uniformly, it is possible to prevent defective image formation.

Consequently, in the image forming apparatus according to the present invention, it is possible to suppress the uneven level of developer in the developing chamber, and to prevent defective image formation which may be caused due to the uneven level of developer, while enabling to facilitate small-sizing and cost reduction.

In the developer container and the image forming apparatus according to the present invention, it is possible to suppress the uneven level of developer to be supplied to the outside of the developer accommodating chamber, to prevent defective image formation which may be caused due to the uneven level of developer, while enabling to facilitate small-sizing and cost reduction.

According to a third aspect of the present invention, there is provided a developer container including:

a housing defining a developer accommodating chamber for accommodating developer, the housing having an opening which communicates an inner side and an outer side of the developer accommodating chamber; and an elastically deformable transporting member configured to rotate in a first direction for transporting the developer accommodated in the developer accommodating chamber, the transporting member being located below the opening of the housing, wherein the housing includes:

a sliding portion located at an upstream side in the first direction with respect to the opening, the sliding portion being configured to elastically deform the transporting member, the opening being configured to allow the transporting member, which has been elastically deformed by the sliding portion, to restore;

a contacting portion located at a downstream side in the first direction with respect to the opening, and configured to contact with the restored transporting member.

DETAILED DESCRIPTION OF THE PREFERRED EMBODIMENTS

<A. Overall Structure of Color Printer>

Figure 1:
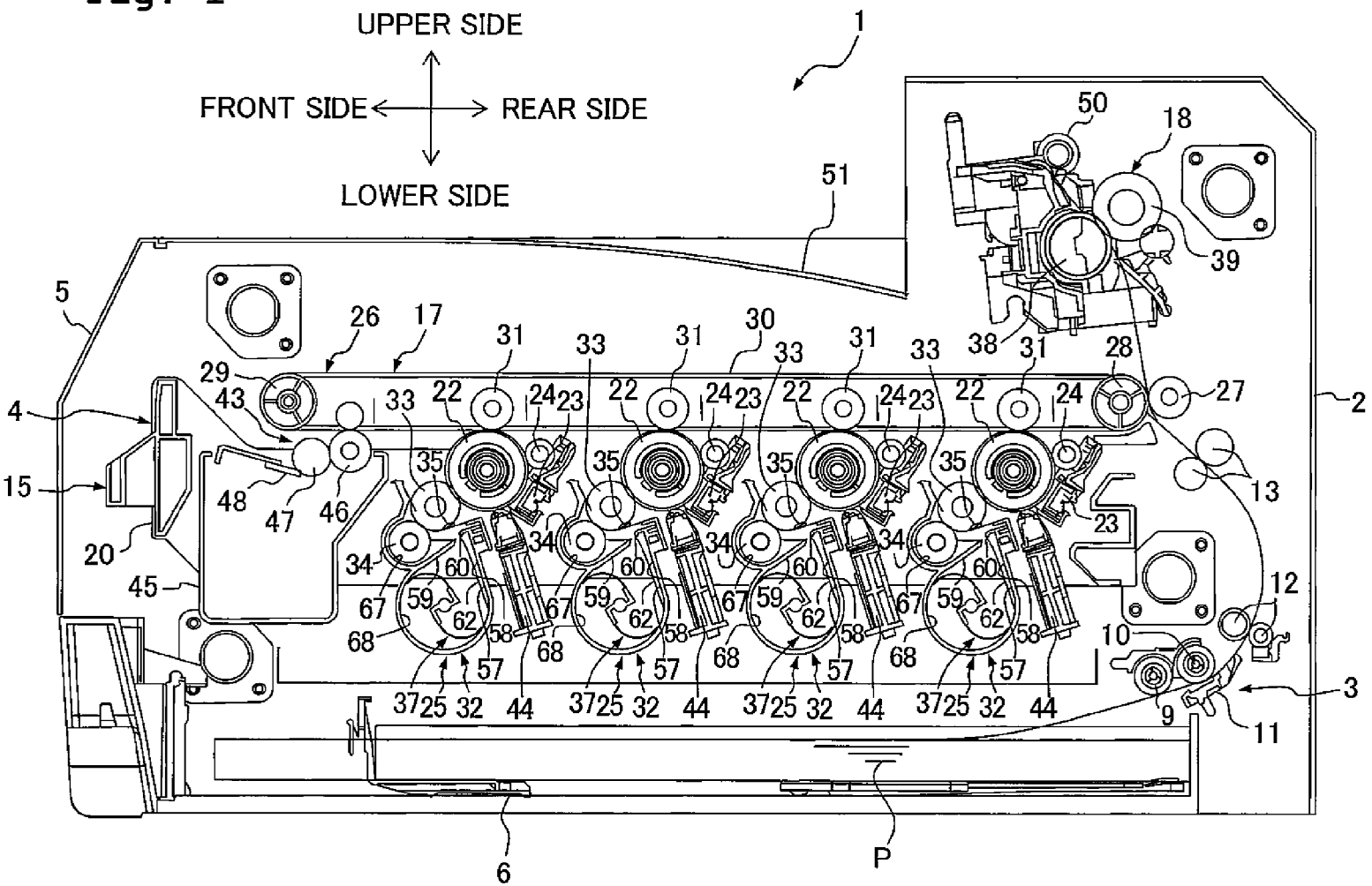
FIG. 1 is a side cross-sectional view of a color printer as an embodiment of an image forming apparatus.

As shown in FIG. 1, a color printer 1 as an example of an image forming apparatus is an intermediate transfer type color printer of a horizontally-mounted type.

Moreover, the color printer 1 includes a main-body casing 2, and a paper feeding section 3 for feeding a paper P, and an image forming section 4 for forming an image on the supplied paper P. The paper feeding section 3 and the image forming section 4 are accommodated in the casing 2.

<1. Main-body Casing>

The main-body casing 2 is formed to be box-shaped in a substantially rectangular form in a side view, and is configured to accommodate the paper feeding section 3 and the image forming section 4. A front cover 5 is swingably or pivotably provided on one side wall of the main-body casing 2. A lower-end portion of the front cover 5 is fixed on the one side wall as a supporting point of a pivot.

In the following description, a side at which the front cover 5 is provided is defined as a front side, and an opposite side thereof is defined as a rear side. In other words, a left side and a right side in FIG. 1 are defined as a front side and a rear side respectively. Moreover, a view of the color printer 1 from a front side is let to be a basis for left and right.

<2. Paper Feeding Section>

The paper feeding section 3 includes a paper feeding tray 6 which is configured to accommodate papers P. The paper feeding tray 6 is detachably installed on a bottom portion inside the main-body casing 2.

Moreover, the paper feeding section 3 is provided with a pickup roller 9 which is arranged at an upper side of a rear-end portion of the paper feeding tray 6, a paper feeding roller 10 which is arranged at a rear side of the pickup roller 9, a paper feeding pad 11 which is arranged to face a lower side of the paper feeding roller 10, a pair of transporting rollers 12 which are arranged at a rear upper side of the paper feeding roller 10, and a pair of register rollers 13 which are arranged at a front upper side of the transporting roller 12, and which are facing mutually.

Papers P (refer to a solid line in FIG. 1) accommodated in the paper feeding tray 6 are sent between the paper feeding roller 10 and the paper feeding pad 11 by the rotation of the pickup roller 9, and are separated one by one by the rotation of the paper feeding roller 10. Thereafter, the paper P which has been separated is fed upwardly toward a gap between the register rollers 13, and is supplied to the image forming section 4 (between an intermediate transfer belt 30 and a secondary transfer roller 27 which will be described later) by the rotation of the register rollers 13 at a predetermined timing.

<3. Image Forming Section>

The image forming section 4 is arranged above the paper feeding section 3, and includes a processing unit 15, a transfer unit 17, and a fixing unit 18.

<3-1. Processing Unit>

The processing unit 15 is provided on an upper side of the paper feeding tray 6, and is configured to be movable along a front-rear direction, between an installing position at which the processing unit 15 is to be installed in the main-body casing 2 and a drawing position at which the processing unit 15 is to be drawn from the main-body casing 2.

The processing unit 15 includes a processing frame 20 and a developing unit 25 as an example of a developer container which is detachably held by the processing frame 20.

The processing frame 20 is formed to be box-shaped in a substantially rectangular form, and is elongated in the front-rear direction in a side view. Further, the processing frame 20 is configured to be slidable in the front-rear direction.

Moreover, the processing frame 20 includes four photosensitive drums 22 as an example of a photosensitive body, four scorotron chargers 23, four drum cleaning rollers 24, four LED units 44, and a belt cleaning unit 43.

Each photosensitive drum 22 is formed to be substantially circular cylinder shaped with a longitudinal direction in the left-right direction, and the four photosensitive drums 22 are arranged in parallel at an interval in the front-rear direction such that an upper portions of the photosensitive drums 22 are exposed from an upper-end edge of the processing frame 20. Moreover, each photosensitive drum 22 is rotatably supported by two side walls which are not shown in the diagram, of the processing frame 20.

Each scorotron charger 23 is arranged to face the corresponding photosensitive drum 22 leaving an interval, on a rear lower side of the corresponding photosensitive drum 22, and is extended in the left-right direction, and is supported by two side walls which are not shown in the diagram, of the processing frame 20.

Each drum cleaning roller 24 is arranged face the photosensitive drum 22 at an upper side of the scorotron charger 23 and at a rear side of the corresponding photosensitive drum 22 such that the drum cleaning roller 24 makes a contact with the photosensitive drum 22. Each drum cleaning roller 24 is extended in the left-right direction and is rotatably supported by two side walls which are not shown in the diagram, of the processing frame 20.

Each LED unit 44 is supported by the processing frame 20 to face the corresponding photosensitive drum 22 from the lower side. The LED unit 44 exposes a surface of the corresponding photosensitive drum 22 based on predetermined image data.

The belt cleaning unit 43 is arranged inside the processing frame 20 at a front side thereof, and includes a waste-developer accommodating portion 45 which is formed to be rectangular box shaped in a side view, a cleaning roller 46 which is provided at an upper end inside the waste developer accommodating portion 45, a scraping roller 47, and a scraping blade 48. A developer on a surface of the intermediate transfer belt 30 (which will be described later) is cleaned by the cleaning roller 46, and after being held on the scraping roller 47 once, the developer is scraped by the scraping blade 48, thereby accommodating in the waste developer accommodating portion 45.

Four developing units 25 corresponding to respective colors are provided. The developing units 25 are arranged at a front lower side of the corresponding photosensitive drums 22, in a state of being held by the processing frame 20, and are arranged in parallel at an interval in the front-rear direction.

Moreover, the developing unit 25, as it will described later in detail, includes a developing frame 32 which includes a developing chamber 67 and a developer accommodating chamber 68.

The developing chamber 67 is provided with a developing roller 33, a supply roller 34, and a layer-thickness regulating blade 35.

The developer accommodating chamber 68 is provided with a transporting member 37 and accommodates a developer of the corresponding color.

<3-2. Transfer Unit>

The transfer unit 17 is arranged above the processing unit 15, and includes a belt unit 26 and the secondary transfer roller 27.

The belt unit 26 is arranged along the front-rear direction, to face each photosensitive drum 22 from an upper side.

The belt unit 26 includes a drive roller 28, a driven roller 29, an intermediate transfer belt 30 as an example of an endless belt, and four primary transfer rollers 31.

The drive roller 28 is arranged to face the driven roller 29 at an interval in the front-rear direction.

The intermediate transfer belt 30 is arranged above each photosensitive drum 22 such that a lower portion of the intermediate transfer belt 30 makes a contact with each photosensitive drum 22, and is put around the drive roller 28 and the driven roller 29. Moreover, the intermediate transfer belt 30 is turned by driving the drive roller 28 and by being driven by the driven roller 29 such that, a lower portion of the intermediate transfer belt 30 which is in contact with each photosensitive drum 22 moves from a front side toward the rear side.

Each primary transfer roller 31 is provided to face each photosensitive drum 22, sandwiching a lower portion of the intermediate transfer belt 30.

The secondary transfer roller 27 is provided at a rear side of the belt unit 26 (one-end side of the intermediate transfer belt 30) to face the drive roller 28, sandwiching the intermediate transfer belt 30.

<3-3. Fixing Unit>

The fixing unit 18 is arranged above the secondary transfer roller 27, and includes a heating roller 38 and a pressurizing roller 39 which makes a pressed contact with the heating roller 38 from an upper side thereof <3-4. Image Forming Operation>

<3-4-1. Developing Operation>

The developer in the developing unit 25 is supplied to the supply roller 34, and furthermore, is supplied to the developing roller 33.

A thickness of the developer supplied to the developing roller 33 is regulated by the layer-thickness regulating blade 35, with the rotation of the developing roller 33, and is carried on a surface of the developing roller 33 as a thin layer of a constant thickness.

On the other hand, after a surface of the photosensitive drum 22 is charged uniformly to a positive electric charge by the scorotron charger 23, the surface of the photosensitive drum 22 is exposed by the LED unit 44. Accordingly, an electrostatic latent image corresponding to an image which is to be formed on the paper P is formed on the surface of the photosensitive drum 22.

As the photosensitive drum 22 rotates further, the developer carried on a surface of the developing roller 33 is supplied to the electrostatic latent image formed on the surface of the photosensitive drum 22. Accordingly, the electrostatic latent image on the photosensitive drum 22 becomes a visible image, and a developer image by inverse developing is formed on the surface of the photosensitive drum 22.

<3-4-2. Transferring—Fixing Operation>

The developer image carried on the surface of the photosensitive drum 22 is subjected to a primary transfer sequentially at a lower portion of the intermediate transfer belt 30 which moves from the front side to the rear side. Accordingly, a color image is formed on the intermediate transfer belt 30.

The color image formed on the intermediate transfer belt 30 is subjected to a secondary transfer on the paper P which is supplied from the paper feeding section 3 while the intermediate transfer belt 30 passes a position facing the secondary transfer roller 27.

Next, the color image which has been transferred to the paper P is subjected to thermal fixing on the paper P in the fixing unit 18 by being heated and pressurized while the paper P passes between the heating roller 38 and the pressurizing roller 39.

<4. Paper Discharge>

The paper P having the developer image fixed thereon in the fixing unit 18 is discharged on to a paper discharge tray 51 which is formed on an upper surface of the main-body casing 2, by a paper discharge roller 50.

<B. Details of Developing Unit>

<1. Developing Frame>

Figure 2:
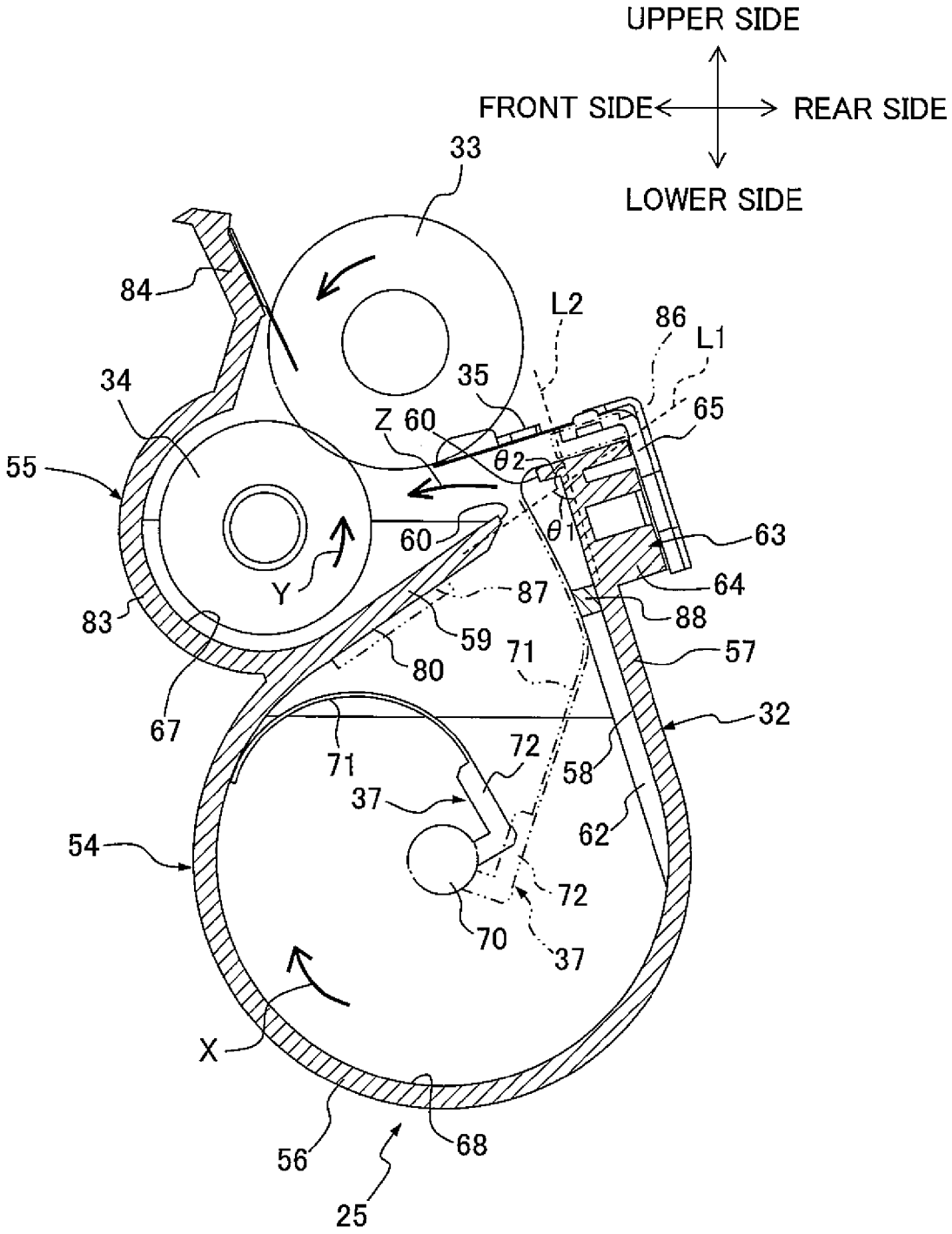
FIG. 2 is a side-sectional view showing an embodiment of a developing unit shown in FIG. 1.

The developing frame 32 (an example of a housing) is formed to have a hollow shape extended in the left-right direction as shown in FIG. 2, and two end portions thereof on left side and right side respectively are closed by two side walls which are not shown in the diagram.

Moreover, the developing frame 32 includes a lower frame 54 and an upper frame 55 which is arranged adjacent to an upper side of the lower frame 54.

The lower frame 54 includes a circular-arc wall 56 and a contacting wall 57.

The circular-arc wall 56 is formed to be substantially circular arc shaped in a side view, which opens toward a rear upper side.

The contacting wall 57 is formed to be substantially flat-plate shaped, and is formed to be projected or protruded obliquely frontward and upward, from a rear-end portion of the circular-arc wall 56.

Moreover, an inner-side surface (a front surface) of the contacting wall 57 is demarcated as a contacting portion 58.

A plurality of projections 62 extended along the vertical direction is provided to the contacting portion 58.

Figure 3:
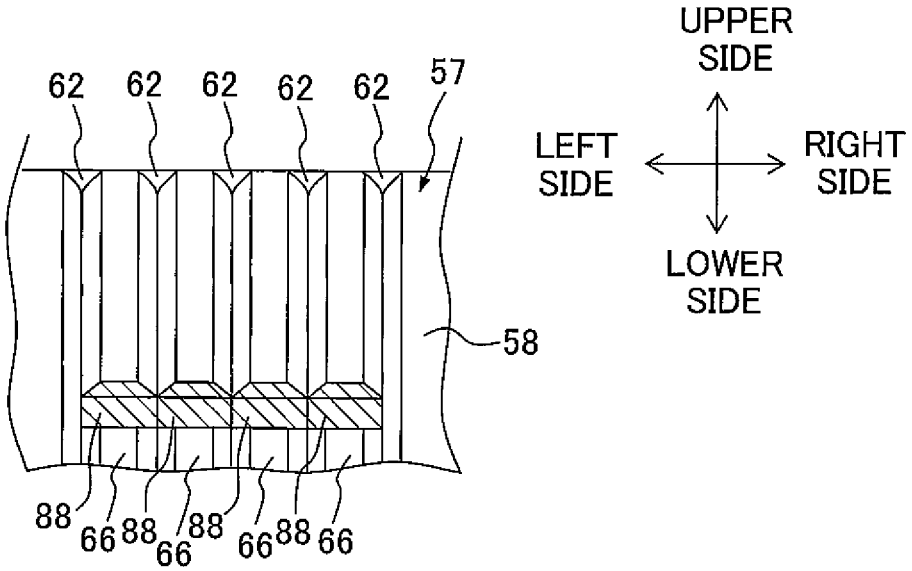
FIG. 3 is a front view of a contacting portion of the developing unit shown in FIG. 1.

As shown in FIG. 3, a cross-sectional surface of each projection 62 is formed to have a substantially triangular shape which is projecting frontward. The projections 62 are arranged in parallel at an interval in the left-right direction (horizontal direction). Moreover, a recess 66 as an example of the recess is formed between the adjacent projections 62.

A damming portion 88 which defines an end of each recess 66 is provided between the two adjacent projections 62 of the recess 66.

As shown in FIG. 2, the damming portion 88 is formed to be substantially rectangular shaped in a side view, and arranged at a position which is substantially ⅓ of a length of the recess 66 from an upper-end portion of each recess 66, in the vertical direction.

Moreover, a blade supporting portion 63 is provided to an outer-side surface (rear surface) of the contacting wall 57.

The blade supporting portion 63 includes a base 64 and a supporting plate 65.

The base 64 is formed to be substantially rectangular shaped in a side view, which is projected rearward, and is formed on an outer side surface of the contacting wall 57 at an upper end portion thereof.

The supporting plate 65 is formed to be L-shaped in a side view, to bend frontward, and is fixed to a rear surface of the base 64. Moreover, the base 64 and the supporting plate 65 are arranged such that a portion of the supporting plate 65 which is bent frontward and an upper surface of the base 64 are arranged to face with an interval in the vertical direction.

A lower portion 83 of the upper frame 55 is formed to be substantially circular arc shaped along an outer peripheral surface of the supply roller 34, and an upper portion 84 of the upper frame 55 is formed to be extended upward from an upper end portion of the lower portion 83, and to bend frontward.

The lower frame 54 and the upper frame 55 are joined, wherein a lower end portion of the lower portion 83 of the upper frame 55 and an upper end portion of the circular-arc wall 56 of the lower frame 54 are joined.

A dividing wall 59 is provided in an internal space of the developing frame 32.

The dividing wall 59 is formed to be a plate shaped and is projected from a joining portion of the circular arc wall 56 and the lower portion 83, along a direction of rotation X of the transporting member 37 (which will be described later), to be extending obliquely upward toward the contacting portion 58. An upper end portion of the dividing wall 59 is cut at a slant to be projected rearward so that an upper side of the dividing wall 59 is more protruded rearward than a lower side thereof.

The upper end portion of the dividing wall 59 is arranged to be positioned at a lower front side with respect to an upper end portion of the contacting wall 57. In other words, an upper end portion of the dividing wall 59 and an upper end portion of the contacting wall 57 are arranged to face with a distance therebetween. Moreover, the upper end portion of the dividing wall 59 is arranged to face a front end portion of the projection 62, with a distance in the frontward-rearward direction.

It is possible to set a supplementary angle θ2 of an angle θ1 in a range between 90 degrees and 160 degrees, wherein the angle θ1 is formed by a straight line L1 along a direction of projection of the dividing wall 59 and a straight line L2 along a direction of projection of the contacting wall 57. In the embodiment, the supplementary angle θ2 may be set to be 126 degrees. Alternatively, the supplementary angle θ2 may be set to be 145 degrees.

A communicating portion 60 is formed by the upper end portion of the dividing wall 59 and the upper end portion of the contacting wall 57.

Accordingly, the internal space of the developing frame 32 is divided into a space at an upper side of the dividing wall 59 and a space at a lower side of the dividing wall 59, and the two spaces communicate via the communicating portion 60.

More elaborately, the space at the upper side of the dividing wall 59 is divided as the developing chamber 67 by an inner side surface of the upper frame 55 and an upper surface of the dividing wall 59. Moreover, the space at the lower side of the dividing wall 59 is divided as the developer accommodating chamber 68 by an inner side surface of the lower frame 54 (an inner side surface of the circular-arc wall 56 and the contacting portion 58), and a lower surface of the dividing wall 59 (a sliding portion 80 (which will be described later)).

In other words, the dividing wall 59 divides the internal space of the developing frame 32 into the developing chamber 67 which is arranged at the upper side, and the developer accommodating chamber 68 which is arranged at the lower side. Moreover, the developing chamber 67 and the developer accommodating chamber 68 communicate via the communicating portion 60.

A lower surface of the dividing wall 59 forms the sliding portion 80.

The sliding portion 80 is arranged between the transporting member 37 and the supply roller 34, in an area facing the transporting member 37 and the supply roller 34.

<2. Developer Accommodating Chamber>

A developer is accommodated in the developer accommodating chamber 68.

An example of a developer is a toner. Concretely, a positively charged non-magnetic single-component toner is an example. A polymer toner can be cited as an example of such toner. A polymer toner has a spherical shape and has an extremely favorable fluidity, and is capable of forming a high quality image.

Moreover, the developer accommodating chamber 68 is provided with a transporting member 37, e.g. an agitator, for stirring the developer accommodated in the developer accommodating chamber 68, and transporting the developer to the developing chamber 67.

The transporting member 37 includes a rotating shaft 70 and a transporting blade 71.

The rotating shaft 70 is positioned at a substantially central portion in a side-sectional view, of the developer accommodating chamber 68, and is extended in the left-right direction. The rotating shaft 70 is rotatably supported by the both side walls (not shown in the diagram) of the developing frame 32.

Moreover, a fixing portion 72 which fixes the transporting blade 71 is formed integrally on the rotating shaft 70.

Figure 5:
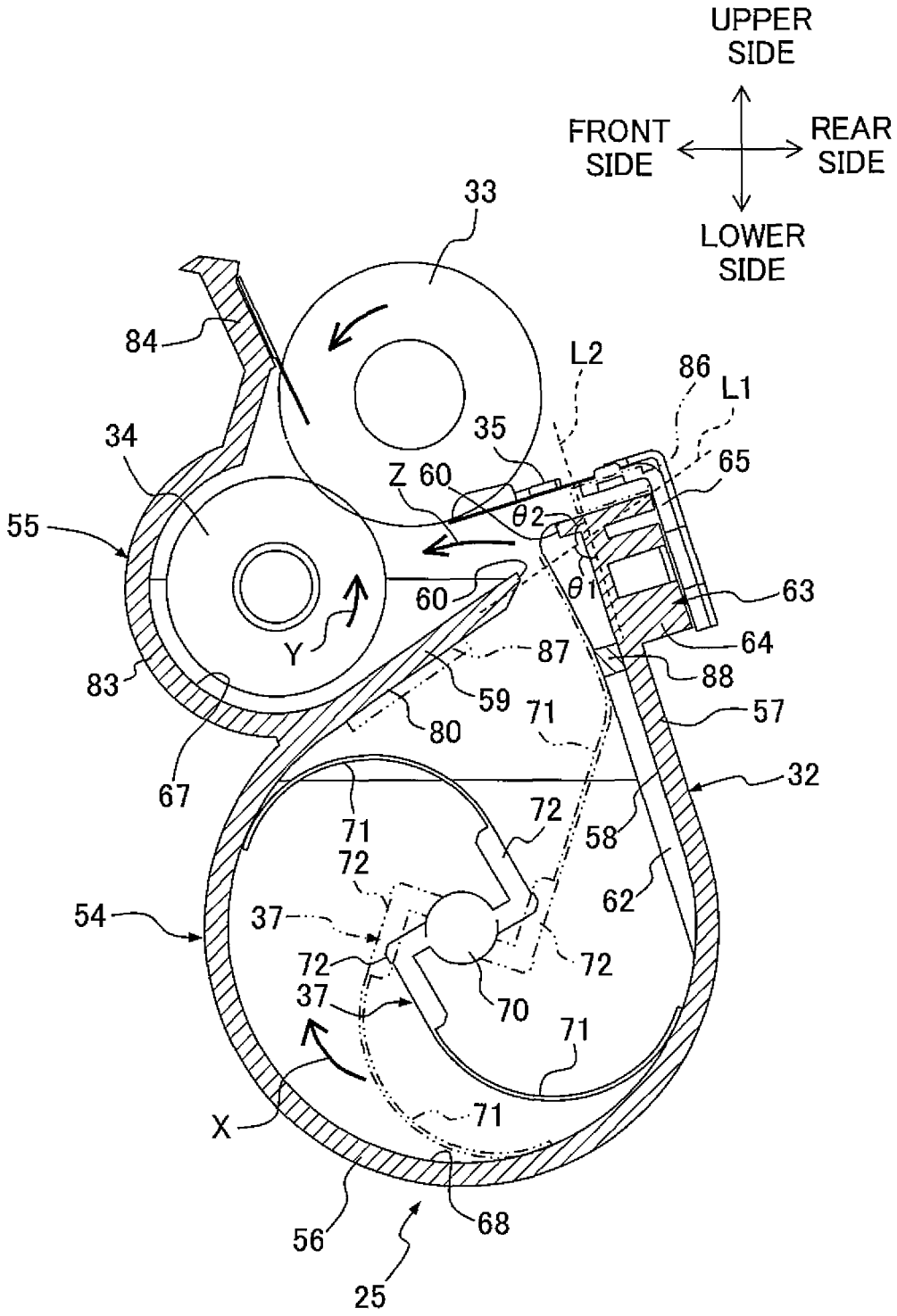
FIG. 5 is a side-sectional view showing another embodiment of a developing unit.

The fixing portion 72 is formed to be substantially L-shaped in a side view, and one end portion thereof is joined to a peripheral surface of the rotating shaft 70. In the embodiment, although there is only one fixing portion 72, two fixing portions 72 may be provided to face with each other in a radial direction of the rotating shaft 70 (refer to FIG. 5).

The transporting blade 71 is formed of a flexible film and has a substantially flat-plate shape which is elastically deformable. The transporting blade 71 is fixed to a free end portion of the fixing portion 72 (end portion of the fixing portion 72 on opposite side of the rotating shaft 70), to be extended toward an outer side of the direction of rotation of the transporting member 37.

When the transporting member 37 is driven to be rotated, the free end portion (end portion on the opposite side of the fixing portion 72) of the transporting blade 71 makes a sliding contact with an inner side surface of the circular arc wall 56, and the sliding portion 80, and the contacting portion 58 (e.g. front end portion of the projection 62).

Moreover, a driving force from a drive source which is not shown in the diagram, such as a motor which is to be provided to the main-body casing 2 is input to the transporting member 37. As the driving force is input to the rotating shaft 70, the rotating shaft 70 is driven to be rotated, and accordingly, the transporting blade 71 rotates in the direction of rotation X (a clockwise direction as viewed from a right-side thereof) shown by an arrow in FIG. 2.

In other words, a base-end portion side of the dividing wall 59 is an upstream side of the direction of rotation X of the transporting member 37, and a free-end portion side is a downstream side of the direction of rotation X of the transporting member 37.

Moreover, the sliding portion 80, the communicating portion 60, and the contacting portion 58 are arranged serially (one after the other) from the upstream side to the downstream side of the direction of rotation X of the transporting member 37.

<3. Developing Chamber>

The developing chamber 67 is provided with the supply roller 34, the developing roller 33, and the layer-thickness regulating blade 35 as an example of the layer-thickness regulating member.

The supply roller 34 is arranged at an inner side of the lower portion 83 of the upper frame 55, and at an upper side of the base end portion of the dividing wall 59, so that a center of rotation coincides with a center of a circular arc of the lower portion 83 of the upper frame 55.

Moreover, the supply roller 34 is extended in the left-right direction, and is rotatably supported by two side walls which are not shown in the diagram, of the developing frame 32.

When viewed from the left-right direction, the center of rotation of the supply roller 34 is positioned at a lower side of a lower end edge of the communicating portion 60, or in other words, at a lower side of the upper end portion of the dividing wall 59.

Figure 4:
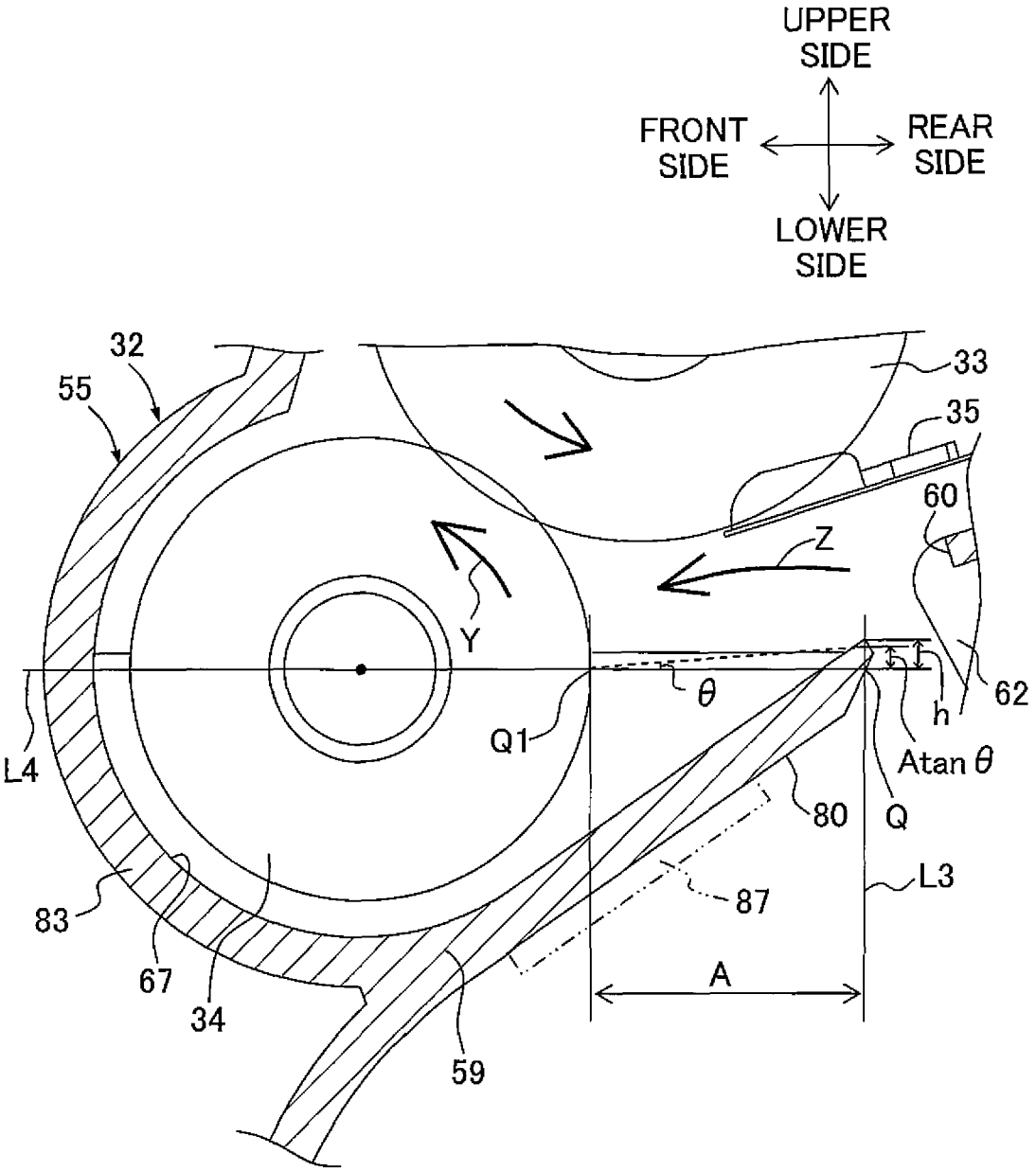
FIG. 4 is an enlarged view of a developing chamber of the developing unit shown in FIG. 1.

Moreover, the supply roller 34 is arranged to satisfy the following expression (1). Here, as shown in FIG. 4, a point of intersection of a straight line L3 extended in a vertical direction including the upper end portion of the dividing wall 59 and a straight line L4 extended in a horizontal direction including the center of rotation of the supply roller 34 is defined as a point of intersection Q. A distance in the horizontal direction between the point of intersection Q and a surface (Q1) of the supply roller 34 is defined as a distance A. A distance in the vertical direction between the upper end portion of the dividing wall 59 and the point of intersection Q is defined as a distance h, and a collapse angle of the developer is defined as θ.

$$h > A \tan \theta \qquad \text{Expression (1)}$$

Moreover, the collapse angle of the developer is an angle of an inclined surface when an apex of developer which has been deposited in a conical shape is made to collapse by an impact of the developer which is supplied to the developing chamber 67, and is calculated with the developer stored in the developer accommodating chamber 68 as a basis when developing of the maximum number of prints of the developing unit 25 is completed.

Concretely, the collapse angle θ of the developer is in a range of 14 degrees to 20 degrees.

At the time of developing, a driving force from a drive source such as a motor which is not shown in the diagram, provided to the main-body casing 2 is transmitted to the supply roller 34. Moreover, at the time of developing, a supply bias is applied to the supply roller 34 from a power supply which is not shown in the diagram. As the driving force from the drive source is transmitted to the supply roller 34, the supply roller 34, as shown in FIG. 2, rotates in a direction opposite to the direction of rotation of the developing roller 33, at a portion (which will be described later) which makes face-to-face contact with the developing roller 33. In other words, the supply roller 34 is driven to rotate in a direction of rotation Y (counterclockwise direction in a right-side view) shown by an arrow in FIG. 2. In other words, the direction of rotation Y of the supply roller 34 is a direction opposite to the direction of rotation X of the transporting member 37.

The developing roller 33 is arranged to face the supply roller 34 at an upper side of the center of rotation of the supply roller 34 such that, an outer peripheral surface on a lower-front side of the developing roller 33 makes a pressed contact with an outer peripheral surface of an upper-rear side of the supply roller 34. Moreover, the developing roller 33 is arranged at an upper side inside the developing chamber 67 such that, a surface of an upper side and of a rear side of the developing roller 33 are exposed from the developing frame 32.

The developing roller 33 is extended in the left-right direction, and is rotatably supported by the two side walls which are not shown in the diagram, of the developing frame 32.

At the time of developing, a driving force from a drive source such as a motor which is not shown in the diagram, provided to the main-body casing 2 is transmitted to the developing roller 33. Moreover, at the time of developing, a developing bias is applied to the developing roller 33 from a power supply which is not shown in the diagram. As the driving force from the drive source is transmitted to the developing roller 33, the developing roller 33 is driven to rotate in the direction of an arrow shown in FIG. 2 (counterclockwise direction in a right-side view) such that the developing roller 33 rotates in an opposite direction of the supply roller 34, at a portion in contact with, and face-to-face with the supply roller 34.

The layer-thickness regulating blade 35 is formed to be substantially flat-plate shaped, and is provided throughout the left-right direction of the developing frame 32.

Moreover, one end portion of the layer-thickness regulating blade 35 is fixed to a free end portion of the supporting plate 65 to make a contact elastically with an outer peripheral surface on a lower side of the developing roller 33. The layer-thickness regulating blade 35 is arranged to be extended from a side of the contacting portion 58 toward the developing roller 33, at an upper side of the communicating portion 60.

A portion of contact between the layer-thickness regulating blade 35 and the developing roller 33 is positioned at a downstream direction in the direction of rotation of the developing roller 33, than a portion of contact between the developing roller 33 and the supply roller 34, at a lower-half portion of the developing roller 33.

The portion of contact between the layer-thickness regulating blade 35 and the developing roller 33 is positioned frontward of the communicating portion 60 when viewed from the vertical direction.

<4. Details of Developing Operation>

Next, details of a developing operation in the developing unit 25 will be described below.

As a driving force is input to the rotating shaft 70 at the time of developing operation, the transporting member 37 rotates in the direction of rotation X.

At this time, the free end portion of the transporting blade 71 is deformed, resisting an elastic force along a shape of the inner peripheral surface of the circular-arc wall 56. Concretely, the transporting blade 71 bends to be warped in a direction opposite to the direction of rotation X.

Moreover, the developer which is accommodated in the developer accommodating chamber 68 is transported toward the sliding portion 80 while being trapped between the inner peripheral surface of the circular-arc wall 56 and the transporting blade 71, with the rotation of the transporting member 37.

Next, as the free end portion of the transporting blade 71 reaches the sliding portion 80, the free end portion of the transporting blade 71 and the sliding portion 80 make a sliding contact. Further, the transporting blade 71, with the developer retained thereon, is maintained in an elastically deformed state along the shape of the sliding portion 80.

As the transporting member 37 rotates further, the free end portion of the transporting blade 71 moves along the inclined dividing wall 59 while making a sliding contact with the sliding portion 80.

As the free end portion of the transporting blade 71 reaches a free end portion of the dividing wall 59, the free end portion of the transporting blade 71 reaches the communicating portion 60 after being moved further rearward, along an inclined surface of the free end portion of the dividing wall 59.

At this time, the sliding contact between the free end portion of the transporting blade 71 and the sliding portion 80 terminates. Therefore, the transporting blade 71 restores substantially flat-plate shape from the elastically deformed state (state of being bent to be warped in the direction opposite to the direction of rotation x). In other words, the free end portion of the transporting blade 71 moves toward the downstream side in the direction of rotation X of the transporting member 37.

Accordingly, with the restoration of the transporting blade 71, some of the developer transported by the transporting blade 71 is transported to the downstream side in the direction of rotation X of the transporting member 37, or in other words, is transported toward the contacting portion 58 and is dispersed upon colliding with the contacting portion 58.

Further, the developer which has dispersed is supplied to the developer chamber 67 via the communicating portion 60 in a direction of supply Z which is opposite to the direction of rotation X of the transporting member 37, by an air flow which is generated by the collision of the transporting member 37 with the contacting portion 58. The direction of supply Z is indicated by an arrow in a counterclockwise direction in FIG. 2.

The developer flows into a space secured in the recess 66 provided to the contacting portion 58, and collides with a bottom portion of the recess 66 (a front surface of the recess 66). As the developer collides with the bottom portion of the recess 66, the developer is dispersed by being reflexed at the bottom portion of the recess 66.

Moreover, a downward flow of the developer dispersed is intercepted by the damming portion 88 provided between the recesses 66. Moreover, the recess 66 being open at an upper side, the developer dispersed is jetted from the upper side of the recess 66, and upon being spread in the space, is supplied in the direction of supply Z which is opposite to the direction of rotation X of the transporting member 37, to the developing chamber 67.

At this time, since the layer-thickness regulating blade 35 is provided at an upper side of the communicating portion 60, the developer spread in the space is restricted from moving above the layer-thickness regulating blade 35 by a lower surface of the layer-thickness regulating blade 35.

Next, the developer supplied to the developing chamber 67 falls due to the gravitation force, and is deposited uniformly on an upper surface of the dividing wall 59, and is accumulated in the developing chamber 67.

Since the dividing wall 59 is inclined, the developer moves toward a base-end portion along the slope of the dividing wall 59, or in other words, toward an area near the supply roller 34.

At this time, the developer supplied newly is accumulated at the downstream side in the direction of rotation of the supply roller 34 at the communicating portion 60 side (rear half portion) of the supply roller 34, than the developer which has been accumulated in the developing chamber 67. Therefore, the developer which is supplied newly is supplied to the developing roller 33 by the supply roller 34 with a higher priority over the developer which has been accumulated.

The developer supplied to the developing roller 33 is held on the surface of the developing roller 33 upon the thickness being regulated by the layer-thickness regulating blade 35 as mentioned above.

Further, the developer which is held on the developing roller 33 is supplied to an electrostatic latent image which is formed on the surface of the photosensitive drum 22. Accordingly, a developer image is formed on the surface of the photosensitive drum 22 by inverse developing.

Meanwhile, the transporting blade 71 which has passed the communicating portion 60 collides with the front end portion of each projection 62 and undergoes elastic deformation once again with the rotation of the transporting member 37.

<C. Technical Effect>

According to the developing unit, as shown in FIG. 2, as the free end portion of the transporting blade 71 of the transporting member 37 reaches the communicating portion 60, the sliding contact with the sliding portion 80 terminates, and due to the elastic force, the transporting blade 71 restores the substantially flat-plate shape from the state of being deformed to be bent.

Therefore, some of the developer which is transported to the transporting blade 71 is dispersed when the developer is discharged to the communicating portion 60, with the restoring of the transporting blade 71. Further, the developer which has not been discharged to the communicating portion 60 is transported toward the contacting portion 58 and is dispersed upon colliding with the contacting portion 58 together with the transporting member 37.

Accordingly, the developer which has dispersed is supplied from the communicating portion 60 to the developing chamber 67 by the air flow generated by the transporting member 37 which has collided with the contacting portion 58. In other words, the developer which has dispersed favorably is supplied to the developing chamber 67 from the direction of supply Z which is opposite to the direction of rotation X of the transporting member 37.

Therefore, it is possible to suppress uneven level of developer in the developing chamber 67.

As a result, since the developer is supplied to the supply roller 34 uniformly, and carried on the developing roller 33 uniformly, it is possible to prevent defective image formation.

Consequently, in the developing unit 25, it is possible to suppress the uneven level of developer in the developing chamber 67, and to prevent the defective image formation caused by the uneven level of developer, while making it possible to facilitate small-sizing and low cost. Moreover, the direction of rotation Y of the supply roller 34 is opposite to the direction of rotation x of the transporting member 37.

Therefore, at a side where the supply roller 34 transports the developer to the developing roller 33, it is possible to supply the developer to the supply roller 34. In other words, since it is possible to supply the developer to the supply roller 34, at a rear side of the supply roller 34 in FIG. 2, it is possible to prevent the developer from being packed between the supply roller 34 and the upper surface of the dividing wall 59, and to supply the developer sufficiently to the developing roller 33. Moreover, in the developing chamber 67, it is possible to suppress the aggregate of the developer which is generated by being accumulated, from being supplied to the developing roller 33.

Consequently, it is possible to prevent the developer from being packed between the supply roller 34 and the upper surface of the dividing wall 59, and the defective image formation which is caused by the aggregate of the developer being supplied to the developing roller 33. The contacting portion 58 includes the plurality of projections 62 extended along the vertical direction, which are arranged at an interval in the horizontal direction to allow the inflow of the developer therebetween. The space between the adjacent projections 62 is demarcated as the recess 66.

Therefore, when the transporting blade 71 has collided with the front-end portion of the projection 62, the developer transported by the transporting blade 71 flows into the space secured by each recess 66.

As a result, it is possible to prevent that the developer is trapped between the transporting blade 71 and the contacting portion 58, and is compressed to be aggregated by a rotative force of the transporting member 37.

Moreover, since the upper side of each recess 66 is open, the developer which has flowed into each recess 66 is jetted upward from each recess 66.

Therefore, it is possible to facilitate an increase in an amount of supply of the developer while suppressing the generation of the aggregate of the developer. Moreover, the damming portion 88 which blocks each recess 66 is provided to each recess 66 at an area between the adjacent projections 62.

Therefore, a downward flow of the developer which has flowed into each recess 66 is regulated.

As a result, it is possible to facilitate the increase in the amount of developer which is jetted upward from each recess 66, and to facilitate an increase in the amount of supply of the developer to the developing chamber 67. Moreover, the dividing wall 59 is formed to be inclined upward toward rear side, from a joining portion of the lower frame 54 and the upper frame 55. In other words, the dividing wall 59 is formed to be extending obliquely upward, from an inner-side surface of the front side (first inner-side surface) of the developing frame 32 toward an inner-side surface of the rear side (second inner-side surface).

Therefore, the developer supplied to the developing chamber 67 moves along the slope of the dividing wall 59, and is accumulated at a front side of the developing chamber 67, or in other words, in an area near the supply roller 34.

Therefore, it is possible to supply the developer to the supply roller 34 stably, and to suppress an occurrence of defective image formation which is caused due to an insufficient supply of the developer to the developing roller 33. Moreover, the upper end portion of the dividing wall 59 is positioned at an upper side of the center of rotation of the supply roller 34. Here, as shown in FIG. 4, the point of intersection of the straight line L3 extended in the vertical direction including the upper end portion of the dividing wall 59 and the straight line L4 extended in the horizontal direction including the center of rotation of the supply roller 34 is defined as the point of intersection Q. At this time, an arrangement is made such that the distance A in a horizontal direction between the point of intersection Q, and the surface (Q1) of the supply roller 34, the distance h in the vertical direction between the upper end portion of the dividing wall 59 and the point of intersection Q, and the collapse angle θ of the developer satisfy an expression of $h > A \tan \theta$.

Therefore, even when the collapse angle θ of the developer becomes large with the developing operation of the developing unit 25, it is possible to supply the developer above the center of rotation of the supply roller 34.

Concretely, it is possible to supply the developer above the point of intersection Q1 of the straight line L4 and the surface of the supply roller 34.

As a result, it is possible to supply the developer sufficiently from the supply roller 34 to the developing roller 33. Moreover, the contacting wall 57 is formed to be projected to be inclined toward the communicating portion 60 (toward the front side), in the upward direction.

Accordingly, the contacting portion 58 is arranged near the communicating portion 60.

Therefore, it is possible to facilitate the increase in the amount of developer which is to be supplied to the developing chamber 67 along the direction of supply Z, from the communicating portion 60, upon being hit and reflexed at the contacting portion 58. Moreover, an upper end of the contacting wall 57 is positioned above an upper end of the dividing wall 59.

Therefore, it is possible to provide the contacting portion 58 further above, or in other words, toward the developing chamber 67. Consequently, it is possible to facilitate the increase in the amount of supply of developer. The communicating portion 60 is positioned above the center of rotation of the supply roller 34, when projected in the left-right direction. In other words, a lower-end edge of the communicating portion 60, or in other words, the free end portion (upper end portion) of the dividing wall 59 is positioned above the center of rotation of the supply roller 34.

Therefore, it is possible to accumulate the developer in the developing chamber 67 till a level of the developer reaches above the center of rotation of the supply roller 34.

As a result, it is possible to supply the developer to the supply roller 34 steadily, and to suppress further the occurrence of defective image formation which is caused due to the insufficient supply of developer to the developing roller 33. Moreover, the developing unit 25 includes the layer-thickness regulating blade 35.

The layer-thickness regulating blade 35 is arranged to be extended from the contacting portion 58 toward the developing roller 33, above the communicating portion 60.

Therefore, the developer which has been supplied to the developing chamber 67, particularly, the developer filled in the space, is restricted from moving above the layer-thickness regulating blade 35 by the lower surface of the layer-thickness regulating blade 35.

Therefore, it is possible to prevent the developer from being supplied to (adhered to) the developing roller 33 without being supplied by the supply roller 34.

As a result, it is possible to prevent defective image formation which is caused due to an unintended supply (deposition, adhesion) of developer to the developing roller 33. Moreover, a supplementary angle of an angle formed by a straight line along the direction of projection of the dividing wall 59 and a straight line along the direction of projection of the contacting wall 57 is in the range of 90 degrees to 160 degrees. (For example, the supplementary angle is 126 degrees.)

Therefore, it is possible to facilitate the increase in the amount of developer supplied to the developing chamber 67. Moreover, the color printer 1 includes the developing unit 25.

Therefore, the color printer 1 is capable of suppressing the uneven level of developer in the developing chamber 67 and to prevent the defective image formation caused due to the uneven level of developer, while facilitating small-sizing and low cost.

D. Modified Embodiment

It is also possible to include a fan 86 as an example of an air flow generator in the abovementioned developing unit 25.

In this case, the fan 86 is provided at an upper end portion of the contacting wall 57 as shown by virtual lines in FIG. 2. More elaborately, the fan 86 is provided to an upper surface of the base 64 to generate an air flow from a side (rear side) of the contacting portion 58 toward the communicating portion 60 (front side), above (at the upper side of) the communicating portion 60.

In this modified embodiment, since the air flow is generated from the side (rear side) of the contacting portion 58 toward the communicating portion 60 (front side), due to the air flow, the developer which is spread in the space by being reflexed upon hitting the contacting portion 58 is supplied to the developing chamber 67 favorably. Therefore, it is possible to facilitate the increase in the amount of supply of developer.

Moreover, it is also possible to include further an elastic portion 87 in the developing unit 25.

In this case, the elastic portion 87 is formed to be substantially sheet-shaped by an elastically deformable member (such as rubber), and is stuck to the sliding portion 80 as shown by virtual lines in FIG. 2.

In the present modified embodiment, when the transporting blade 71 makes a sliding contact with the sliding portion 80, the transporting blade 71 makes a contact with the elastic portion 87. Therefore, the transporting blade 71 vibrates and enables to prevent the aggregation of the developer which is transported by the transporting blade 71.

Moreover, in the developing unit 25, the transporting member 37 includes one transporting blade 71 and one fixing portion 72 which fixes the transporting blade 71. However, the present teaching is not restricted to such arrangement, and the transporting member 37 may include arbitrary number of transporting blades 71 and fixing portions 72. For instance, the transporting member 37 may include two transporting blades 71 and two fixing portions 72.

In this case, two fixing portions 72 are provided to face with each other in a radial direction of the rotating shaft 70.

In the present modified embodiment, it is possible to transport the developer accommodated in the developer accommodating chamber 68 to the developing chamber 67 efficiently.

In the embodiment, the developing unit 25 is exemplified as the developer container. However, the present teaching is not restricted to such an arrangement, and is applicable to an arbitrary developer container. For instance, the developer container may be a toner cartridge.

It is possible to combine the abovementioned modified embodiments appropriately.

What is claimed is:

1. A developer container comprising:

a developer accommodating chamber configured to accommodate the developer;

a transporting member configured to elastically deform and to rotate in the developer accommodating chamber, and further configured to transport the developer accommodated in the developer accommodating chamber, a developing chamber communicating with the developer accommodating chamber at a communicating portion of the developer accommodating chamber; and a developing roller arranged in the developing chamber, wherein the developer accommodating chamber includes:

a dividing wall having a sliding portion configured to deform the transporting member by making a sliding contact with the transporting member, the dividing wall defining a part of the developer accommodating chamber to divide the developer accommodating chamber and an upper space thereof;

the communicating portion arranged at a downstream side in a direction of rotation of the transporting member with respect to the sliding portion, the communicating portion communicating an inner side and an outer side of the developer accommodating chamber, the communicating portion being configured to allow the transporting member, which has been elastically deformed by the sliding portion, to restore; and a contacting portion arranged at the downstream side in the direction of rotation of the transporting member with respect to the communicating portion, the transporting member restored by the communicating portion being configured to contact with the contacting portion, and wherein, in a state that the developer container is installed into an image forming apparatus, the developing chamber is arranged at an upper side of the developer accommodating chamber, and the communicating portion is arranged at an upper side of the transporting member and at a lower side of the developing roller.

2. The developer container according to claim 1, wherein the contacting portion includes a recess configured to allow the developer, which is transported by the transporting member, to flow thereto.

3. The developer container according to claim 2, wherein the contacting portion includes a pair of projections extended in a vertical direction and arranged at intervals in a horizontal direction, and wherein the recess is located between the pair of projections.

4. The developer container according to claim 3, wherein the contacting portion includes a damming portion defining an end of the recess, the damming portion configured to intercept a downward flow of the developer which has flowed into the recess.

5. The developer container according to claim 1, further comprising an air flow generating portion configured to generate an air flow from the contacting portion toward the communicating portion.

6. The developer container according to claim 1, wherein the developer accommodating chamber includes a contacting wall which includes the contacting portion, wherein the contacting wall is formed to be inclined such that the contacting wall has a first distance between an upper portion of the contacting wall and a virtual vertical plane and has a second distance between an lower portion of the contacting wall and the virtual vertical plane, the first distance being less than the second distance, and wherein the virtual vertical plane extends in a vertical direction and includes a boundary line between the contacting wall and the communicating portion.

7. The developer container according to claim 6, wherein an upper end of the contacting wall is arranged above an end portion, of the dividing wall, of a communicating portion side.

8. The developer container according to claim 6, wherein a supplementary angle of an angle, which is formed by a straight line extending along the dividing wall and perpendicular to a rotational axis of the transporting member with a straight line extending along the contacting wall and perpendicular to the rotational axis of the transporting member, is in a range not less than 90° and not more than 160°.

9. The developer container according to claim 1, wherein the sliding portion includes an elastic portion which is elastically deformable.

10. The developer container according to claim 1, further comprising:

a supply roller arranged below the developing roller in the developing chamber and configured to rotate for supplying the developer to the developing roller, wherein the developing chamber is arranged above the dividing wall so that the sliding portion is arranged between the transporting member and the supply roller.

11. The developer container according to claim 10, wherein a direction of rotation of the supply roller is opposite to the direction of rotation of the transporting member.

12. The developer container according to claim 10, wherein the dividing wall includes:

a first inner-side surface arranged at an upstream side in the direction of rotation of the transporting member with respect to the dividing wall; and a second inner-side surface arranged at the downstream side in the direction of rotation of the transporting member with respect to the dividing wall, wherein the dividing wall extends obliquely upward, from the first inner-side surface toward the second inner-side surface.

13. The developer container according to claim 12, wherein:

an upper end portion of the dividing wall is positioned at an upper side of a center of rotation of the supply roller, and the dividing wall is arranged such that, when a collapse angle of the developer in the developing chamber is defined as $\theta$, a distance in a horizontal direction between the supply roller and a point of intersection of a straight line extended in a vertical direction including the upper end portion of the dividing wall and a straight line extended in a horizontal direction including the center of rotation of the supply roller is defined as A, and a distance in the vertical direction between the upper end portion of the dividing wall and the point of intersection is defined as h, then $\theta$, A, and h satisfy a relationship $h>A \tan \theta$.

14. The developer container according to claim 10, wherein the communicating portion is positioned at an upper side of a center of rotation of the supply roller.

15. The developer container according to claim 10, further comprising a layer-thickness regulating member extending from a contacting portion side toward the developing roller and located above the communicating portion, the layer-thickness regulating member being configured to regulate a layer thickness of the developer which is held on the developing roller.

16. An image forming apparatus configured to form an image on a medium, comprising:

a plurality of developer containers as defined in claim 1;

a plurality of photosensitive drums arranged above the developer containers, corresponding to the plurality of developer containers;

an endless belt arranged above the photosensitive drums;

a plurality of primary transfer rollers arranged to face the photosensitive drums, sandwiching the endless belt between the primary transfer rollers and the photosensitive drums; and a secondary transfer roller arranged at one end side of the endless belt.

17. A developer container comprising:

a housing defining a developer accommodating chamber for accommodating developer, the housing having an opening which communicates an inner side and an outer side of the developer accommodating chamber;

an elastically deformable transporting member configured to rotate in a first direction for transporting the developer accommodated in the developer accommodating chamber, the transporting member being located below the opening of the housing;

a developing chamber communicating with the developer accommodating chamber at the opening; and a developing roller arranged in the developing chamber, wherein the housing includes:

a sliding portion located at an upstream side in the first direction with respect to the opening, the sliding portion being configured to elastically deform the transporting member, the opening being configured to allow the transporting member, which has been elastically deformed by the sliding portion, to restore; and a contacting portion located at a downstream side in the first direction with respect to the opening, and configured to contact with the restored transporting member, and wherein, in a state that the developer container is installed into an image forming apparatus, the developing chamber is arranged at an upper side of the developer accommodating chamber, and the opening is arranged at an upper side of the transporting member and at a lower side of the developing roller.

18. The developer container according to claim 17, wherein the contacting portion includes a recess configured to allow the developer, which is transported by the transporting member, to flow thereto.

19. The developer container according to claim 18, wherein the contacting portion includes a pair of projections extended in a substantially vertical direction and arranged at intervals in a substantially horizontal direction, and wherein the recess is located between the pair of projections.

20. The developer container according to claim 19, wherein the contacting portion includes a damming portion defining an end of the recess, the damming portion configured to intercept a downward flow of the developer which has flowed into the recess.

21. The developer container according to claim 17, further comprising an air flow generating portion configured to generate an air flow from a contacting portion toward the opening.

22. The developer container according to claim 17, wherein the contacting portion is formed to be inclined such that the contacting portion has a first distance between an upper portion of the contacting portion and a virtual vertical plane and has a second distance between an lower portion of the contacting portion and the virtual vertical plane, the first distance is less than the second distance, the virtual vertical plane extending in a vertical direction and including a boundary line between the contacting portion and the opening.

23. The developer container according to claim 22, wherein the sliding portion has a downstream end in the first direction, and wherein the contacting portion has an upper end which is positioned above the downstream end of the sliding portion.

24. The developer container according to claim 22, wherein a supplementary angle of an angle formed by a first plane along the sliding portion with a second plane along the contacting portion is in a range not less than 90° and not more than 160°.

25. The developer container according to claim 17, wherein the sliding portion includes an elastic portion which is elastically deformable.

26. The developer container according to claim 17, further comprising:

a developing roller configured to hold the developer, and a supply roller arranged below the developing roller and configured to rotate in a second direction for supplying the developer to the developing roller, wherein the housing further defines a developing chamber which communicates with the developer accommodating chamber through the opening, wherein the developing chamber is located above the developer accommodating chamber, and wherein the sliding portion is located between the transporting member in the developer accommodating chamber and the supply roller in the developing chamber.

27. The developer container according to claim 26, wherein the second direction is opposite to the first direction.

28. The developer container according to claim 26, wherein the sliding portion includes an first inner-side surface positioned at an upstream side in the first direction and a second inner-side surface positioned at the downstream side in the first direction, wherein the sliding portion extends obliquely upward, from the first inner-side surface toward the second inner-side surface.

29. The developer container according to claim 28, wherein the sliding portion has an upper end which is positioned at an upper side of a center of rotation of the supply roller, the housing is arranged such that, when a collapse angle of the developer in the developing chamber is defined as $\theta$, a distance in a horizontal direction between the supply roller and a point of intersection of a straight line extended in a vertical direction including the upper end portion of the sliding portion and a straight line extended in a horizontal direction including the center of rotation of the supply roller is defined as A, and a distance in the vertical direction between the upper end portion of the sliding portion and the point of intersection is defined as h, then $\theta$, A, and h satisfy a relationship $h>A \tan \theta$.

30. The developer container according to claim 26, wherein the opening is positioned at an upper side of a center of rotation of the supply roller.

31. The developer container according to claim 26, further comprising a layer-thickness regulating member extending from a contacting portion side toward the developing roller and located above the opening, the layer-thickness regulating member being configured to regulate a layer thickness of the developer which is held on the developing roller.

32. An image forming apparatus which forms an image on a medium, comprising:

a plurality of developer containers as defined in claim 17;

a plurality of photosensitive drums arranged above the developer containers, corresponding to the plurality of developer containers;

an endless belt arranged above the photosensitive drums;

a plurality of primary transfer rollers arranged to face the photosensitive drums, sandwiching the endless belt between the primary transfer rollers and the photosensitive drums; and a secondary transfer roller which is arranged at one end side of the endless belt.

* * * * *